US008011976B2

(12) United States Patent
Ooki

(10) Patent No.: US 8,011,976 B2
(45) Date of Patent: Sep. 6, 2011

(54) WATERPROOF CONNECTOR AND METHOD FOR PRODUCING THE SAME

(75) Inventor: Yuusaku Ooki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 53 days.

(21) Appl. No.: 12/385,495

(22) Filed: Apr. 9, 2009

(65) Prior Publication Data

US 2009/0258521 A1 Oct. 15, 2009

(30) Foreign Application Priority Data

Apr. 11, 2008 (JP) ..... 2008-103155

(51) Int. Cl.
*H01R 13/405* (2006.01)

(52) U.S. Cl. ..... 439/736; 439/936

(58) Field of Classification Search ..... 439/736, 439/587, 722, 936
See application file for complete search history.

(56) References Cited

U.S. PATENT DOCUMENTS

| | | | | |
|---|---|---|---|---|
| 5,580,264 | A | 12/1996 | Aoyama et al. | |
| 6,616,480 | B2 * | 9/2003 | Kameyama | 439/587 |
| 7,438,576 | B2 * | 10/2008 | Sakakura | 439/206 |
| 7,445,481 | B2 * | 11/2008 | Nagashima et al. | 439/276 |
| 2004/0235364 | A1 * | 11/2004 | Matsumoto et al. | 439/752 |
| 2005/0255755 | A1 * | 11/2005 | Mott | 439/736 |
| 2006/0199440 | A1 * | 9/2006 | Holtz | 439/736 |

FOREIGN PATENT DOCUMENTS

| | | |
|---|---|---|
| JP | 2002-298656 | 10/2002 |
| JP | 2007-048473 A | 2/2007 |

* cited by examiner

*Primary Examiner* — Hien Vu
(74) *Attorney, Agent, or Firm* — Edwards Angell Palmer & Dodge LLP

(57) ABSTRACT

The present invention is intended to provide a novel waterproof connector in which liquid such as water is securely prevented from adhering to the connection between a terminal fitting and an electrical conduit, and a novel method for producing the waterproof connector.

The novel waterproof connector 1 comprises an electrical conduit (6), a terminal fitting (2), and a sealing member (4). The terminal fitting (2) has an electrical conduit-connecting portion (22) connected to an end portion (6*a*) of the electrical conduit (6). The connector housing (3) is integrally molded with both of the electrical conduit (6) and the terminal fitting (2). In this configuration, at least the electrical conduit-connecting portion (22) is embedded in the connector housing (3). The sealing member (4) comprises a synthetic polymer component having adhesion properties and elasticity. The sealing member (4) is at least partly wrapped around both the end portion (6*a*) of the electrical conduit (6) and the terminal fitting (2) so as to be in close contact with both the corresponding end portion (6*a*) of the electrical conduit (6), and the corresponding terminal fitting (2). In this configuration, wherein all of the corresponding end portion (6*a*) of the electrical conduit (6), the corresponding terminal fitting (2), and the sealing member (4) are embedded in the connector housing (3).

2 Claims, 5 Drawing Sheets

WATERPROOF CONNECTOR AND METHOD FOR PRODUCING THE SAME

CROSS-REFERENCE TO RELATED APPLICATIONS

The present Application claims priority to Japanese Patent Application No. 2008-103155 filed Apr. 11, 2008, the entire disclosure of which is expressly incorporated herein by reference.

BACKGROUND OF THE INVENTION

1. Field of the Invention

The present invention relates to a waterproof connector suited for being disposed in, for example, an engine room and so on of vehicles.

2. Description of the Related Art

Automobiles are generally equipped with a variety of electronic devices. In this reason, a wiring harness is disposed or arranged in the automobiles so as to deliver or transfer a variety of signals, power and so on to the electronic devices disposed therein. The wiring harness generally has a plurality of electrical conduits and a connector connected to the afore-mentioned electrical conduits. The electrical conduit generally has a conductor as a core portion and a covering disposed on the conductor. The conductor may be formed of a plurality of wires or filaments. The covering is generally made of insulating synthetic polymer and so on.

The connector generally has a terminal fitting which is made of electrically-conductive metallic plate, and a connector housing for accommodating or receiving the afore-mentioned terminal fitting. The terminal fitting generally includes an electrical conduit-connecting portion and an electric contact portion. In further detail, the electrical conduit-connecting portion is coupled or connected to the terminal portion of the electrical conduit such that the core portion (i.e., the conductor) is connected thereto. The electrical contact portion is connected to a terminal fitting of a counterpart connector. The connector housing may be box-shaped, and may be also formed of insulating synthetic polymer material and so on. The connector housing has a terminal-accommodating chamber for accommodating or receiving the terminal fitting therein. The connector housing may be coupled to the counterpart connector.

In the afore-mentioned type of the wiring harness, the terminal fitting is coupled to the end portion of the electrical conduit, and is then leaded into the terminal-accommodating chamber. Thereafter, the connector is coupled to the counterpart connector. The wiring harness may be arranged in the vehicle such as automobiles so as to deliver or transfer the desired signal or power to a variety of electronic devices.

Furthermore, in the case of the afore-mentioned wiring harness, in order to prevent liquid such as water from adversely affecting the terminal fitting and so on, a waterproof-type connector has been employed as a connector. In further detail, when the terminal fitting is in contact with liquid such as water, it generally corrodes away. For example, Japanese Publication of Patent Application No. 2002-298656 discloses a conventional waterproof connector.

The waterproof connector as disclosed in Japanese Publication of Patent Application No. 2002-298656 can be kept liquid-tight by imbedding the end portion of the electrical conduit and a tube in the connector housing via a molding process. As such, between the electrical conduit and the connector housing, and between the tube and the connector housing can be kept liquid-tight. Moreover, due to the mold shrinkage, liquid-tightness can be kept between the tube and the end portion of the electrical conduit, and between the tube and the electrical conduit-connecting portion of the terminal fitting, respectively. Further, in this case, a counterpart connector which is coupled to or fit into the afore-mentioned connector may be also a waterproof connector. As such, when two of the waterproof connectors are coupled to each other, liquid such as water can be prevented from penetration into the terminal-accommodating chamber. Accordingly, the terminal fitting can substantially be avoided from being contact with liquid such as water or liquid adhesion.

Also, other type of waterproof connector is depicted in FIG. 6 as designated by a numeral 101. The waterproof connector 101 can be kept liquid-tight by injecting potting material 104 such as silicone rubber in a liquid state into a terminal-accommodating chamber 103, which receives or accommodates a terminal fitting 102 coupled to the end portion 106*a* of an electrical conduit 106. In this configuration, once the potting material 104 is cured, liquid-tightness can be kept inside the terminal-accommodating chamber 103. As such, liquid such as water can be prevented from penetrating into the terminal-accommodating chamber 103.

Meanwhile, in a case where the waterproof connector as disclosed in Japanese Publication of Patent Application No. 2002-298656 is arranged or disposed in the engine room of vehicles such as automobiles, the tube, the covering portion of the electrical conduit, and the terminal fitting are different in their coefficient of thermal expansion (CTE), and due to change in in-vehicle temperature the tube therefore has a tendency of peeling off or being delaminated from the covering and the terminal fitting. As a result, there is high probability that a gap or clearance is created between the tube and the covering of the electrical conduit, and/or between the tube and the terminal fitting. Also, due to the oscillation or vibration created while the automobile is traveling, a gap or clearance is inclined to be created or developed. Once the gap or clearance is created, liquid such as water can easily penetrate into the terminal-accommodating chamber via such a gap or clearance. In this case, liquid might adhere to the connection between the terminal fitting and the electrical conduit (i.e., the electrical conduit-connecting portion).

In addition, in the case of the waterproof connector as depicted in FIG. 6, the potting material 104 should be cured. Accordingly, a period of time should be required for the curing process. In this case, the product is required to remain in-line until the curing process is completed, thus causing the productivity of final product to decrease. Moreover, since the potting material 104 is injected into relatively extensive space within the terminal accommodating chamber 103, the potting material 104 should be employed in a large amount.

The present invention is provided to solve the afore-mentioned problems. In other words, in accordance with the present invention, there are provided a novel waterproof connector in which liquid such as water is securely prevented from adhering to the connection between the terminal fitting and the electrical conduit, and a novel method for producing the waterproof connector.

SUMMARY OF THE INVENTION

In accordance with the first aspect of the invention, there is provided a waterproof connector, which comprises an electrical conduit, a terminal fitting having an electrical conduit-connecting portion connected to an end portion of the electrical conduit, a connector housing being integrally molded with both of the electrical conduit and the terminal fitting, and a sealing member comprising a synthetic polymer component having adhesion properties and elasticity. In this configuration, at least the electrical conduit-connecting portion is embedded in the connector housing; the sealing member is at least partly wrapped around both the end portion of the electrical conduit and the terminal fitting so as to be in close contact with both the corresponding end portion of the electrical conduit, and the corresponding terminal fitting; and all of the corresponding end portion of the electrical conduit, the corresponding terminal fitting, and the sealing member are embedded in the connector housing.

Preferably, the sealing member comprises a first sealing member and a second sealing member. In this configuration, the first sealing member is at least partly wrapped around the end portion of the electrical conduit so as to be in close contact with the corresponding end portion of the electrical conduit; and the second sealing member is spaced apart from the first sealing member so as to position the electrical conduit-connecting portion between the first sealing member and the second sealing member, and is at least partly wrapped around the terminal fitting embedded in the connector housing so as to be in close contact with the corresponding terminal fitting. The end portion of the electrical conduit is embedded in the connector housing.

In accordance with the second aspect of the invention, there is provided a method for producing a waterproof connector, comprising the steps of:

at least partly wrapping a sealing member around both an end portion of an electrical conduit, and a terminal fitting having an electrical conduit-connecting portion connected to the end portion of the electrical conduit such that the sealing member is in close contact with both the corresponding end portion of the electrical conduit, and the corresponding terminal fitting, and integrally molding a connector housing together with the electrical conduit and the terminal fitting so as to imbed at least both the electrical conduit-connecting portion and the sealing member in the connector housing. In this method, the sealing member comprises a synthetic polymer component having adhesion properties and elasticity.

DETAILED DESCRIPTION OF THE INVENTION

Figure 1:
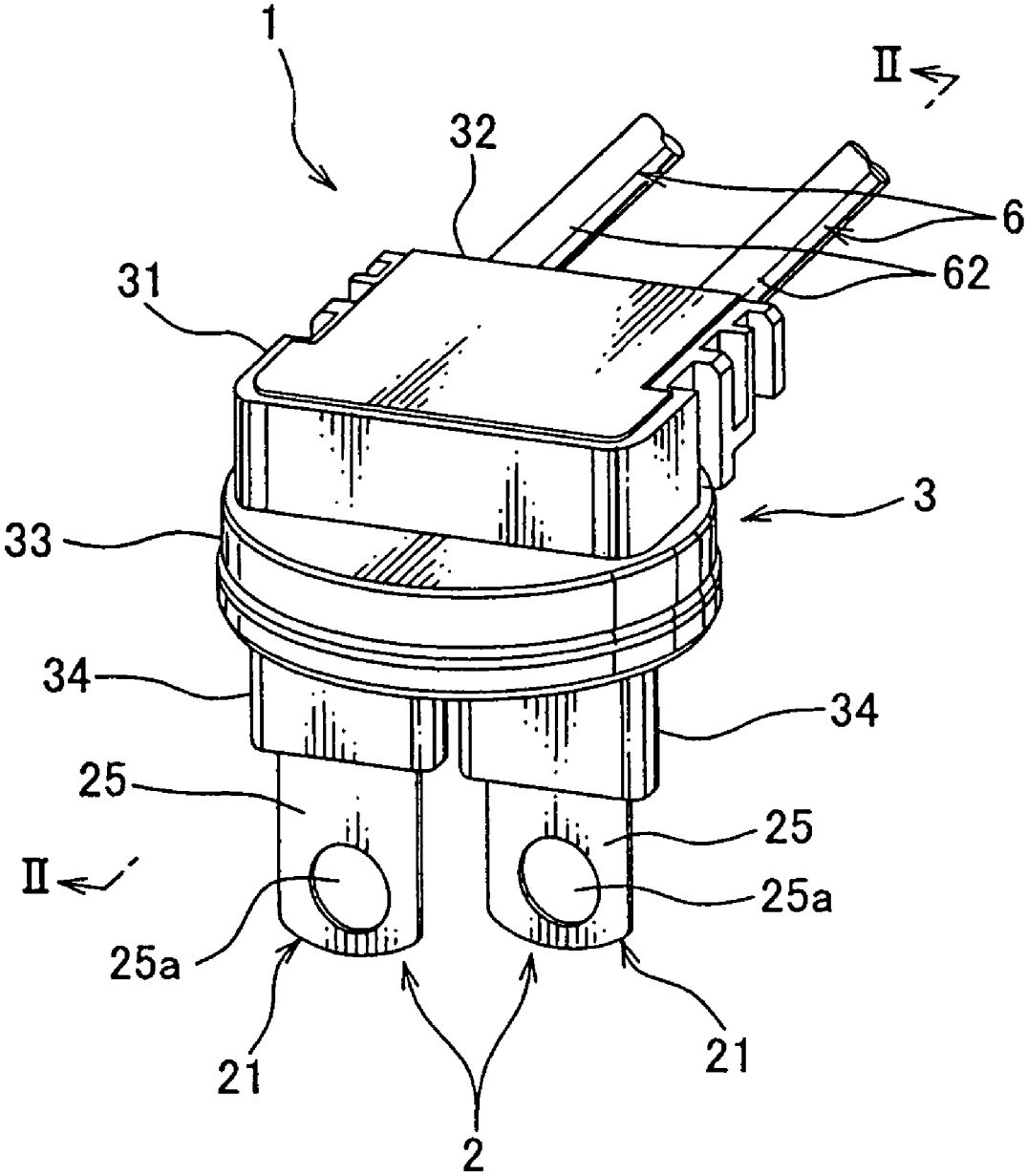
FIG. 1 is a perspective view of one embodiment of a waterproof connector in accordance with the present invention.
Figure 2:
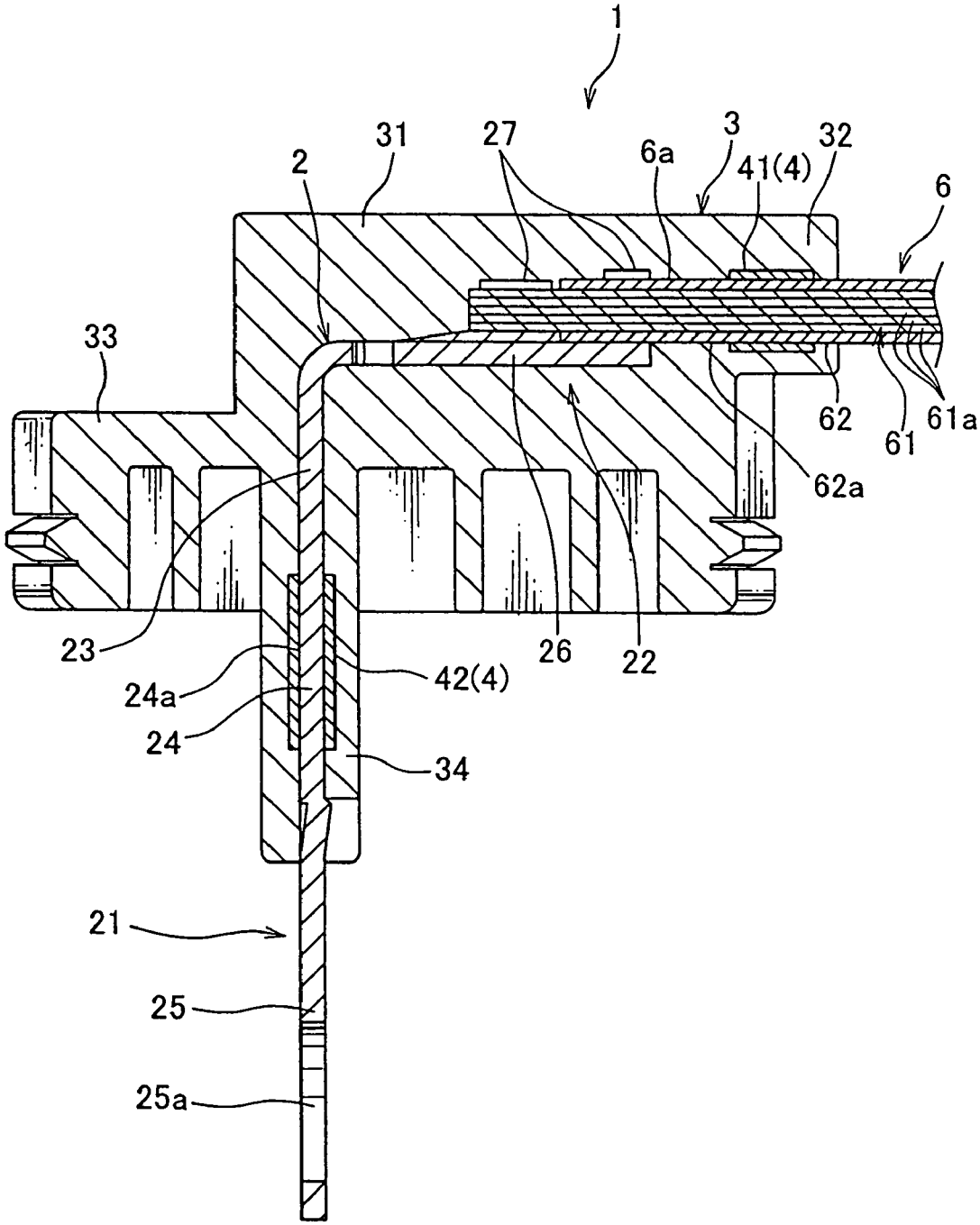
FIG. 2 is a cross-sectional view taken along line II-II in FIG. 1.

The present invention will be described in further detail with reference to FIGS. 1 to 5. As shown in FIGS. 1 and 2, a waterproof connector in accordance with one embodiment of the present invention includes a terminal fitting 2, a connector housing 3, and a sealing member 4 (refer to FIG. 2).

Figure 3:
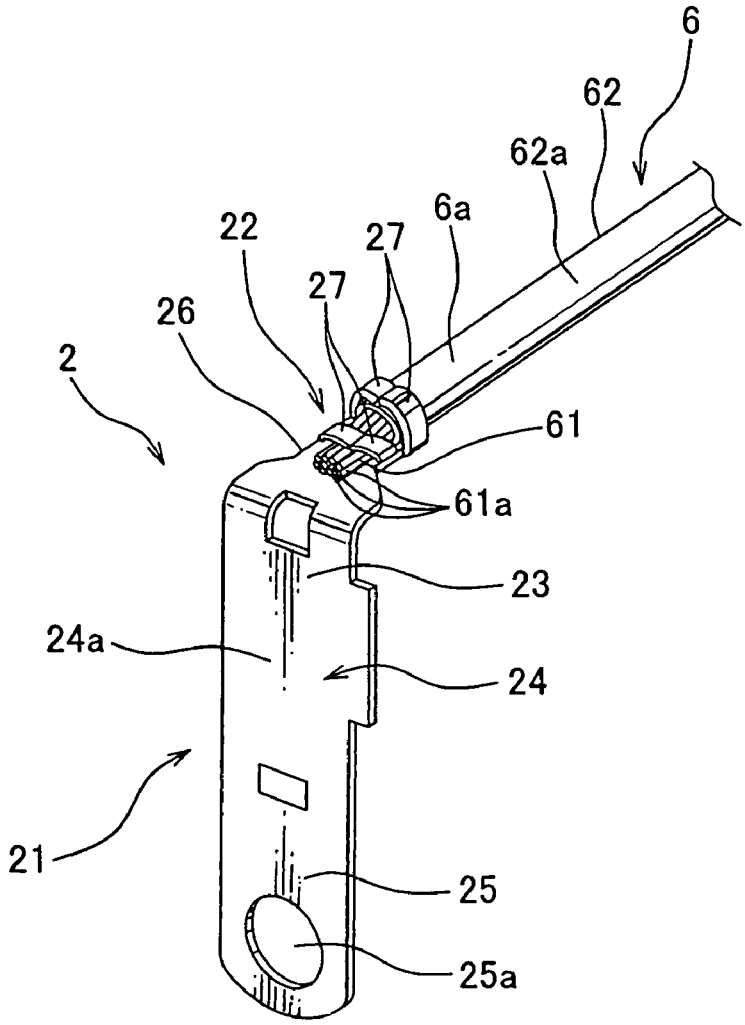
FIG. 3 is a perspective view for the terminal fitting as shown in FIG. 1

The terminal fitting 2 may be formed by folding electrically-conductive metallic plate. The terminal fitting 2 may be formed of copper alloy such as brass. Also, the terminal fitting 2 may be plated with tin, silver, or gold, before or after the folding of the metallic plate. In other words, the outer surface of the terminal fitting 2 may be made of copper alloy, tin, silver, or gold. A plurality of the terminal fittings 2 may be formed. In this embodiment of the present invention, two of the terminal fittings 2 are disposed. As shown in FIG. 3, the terminal fitting 2 correspond to so-called male-type terminal fitting, and is integrally formed with both an electric contact portion 21 and an electrical conduit-connecting portion 22. The terminal fitting 2 may be L-shaped.

The electric contact portion 21 is strip-shaped. With reference to FIG. 2, the base end portion 23 and the center portion 24 of the electric contact portion 21 are embedded in the connector housing 3. In this configuration, the base end portion 23 of the electrical contact portion 21 is disposed adjacent to the electrical conduit-connecting portion 22. The tip portion 25 of the electric contact portion 21 extends through the connector housing 3, and is electrically connected to the terminal fitting (not shown) of a counterpart connector. The tip portion 25 has a through-hole 25*a* disposed therein and configured to engage the terminal fitting of the counterpart connector.

The electrical conduit-connecting portion 22 is also embedded in the connector housing 3, as shown in FIG. 2. The electrical conduit-connecting portion 22 is shown to include a strip-shaped base plate 26, and a plurality of caulking pieces 27. The base plate 26 extends in an orthogonal direction relative to the longitudinal direction of the electric contact portion 21. In further detail, the base plate 26 extends perpendicularly to the electric contact portion 21. In drawings, the base plate 26 is at about 90 degrees relative to the electric contact portion 21.

The caulking piece 27 extends from both opposing end portions of the base plate 26 in a crosswise direction. The caulking piece 27 is folded while approaching to the base plate 26 so as to clip or fix the end portion 6*a* of the electrical conduit 6 to the base plate 26. The caulking piece 27 is configured to caulk the electrical conduit 6. Since the end portion 6*a* of the electrical conduit 6 is caulked by the caulking piece 27, the electrical connect portion 22 is electrically and mechanically connected to the end portion 6*a* of the electrical conduit 6. As a result, the terminal fitting 2 is coupled to the electrical conduit 6.

The electrical conduit 6 generally has a covering. More specifically, as shown in FIG. 2, the electrical conduit 6 includes a core, i.e. a conductor 61 and an insulating covering 62 disposed on the core 61. The core 61 essentially comprises a plurality of wires 61*a*, which is made of electrically conductive metal such as copper, aluminum and so on. The core 61 may be consisted of single wire 61*a*.

The covering 62 of the electrical conduit 6 is made of, for example, synthetic polymer such as polyethylene, polypropylene, and polyvinyl chloride. In other words, an outer face 62*a* of the covering 62 is made of, for example, synthetic polymer such as polyethylene, polypropylenes, and polyvinyl chloride. Furthermore, an additive may be added to the synthetic polymer. The additive includes, but is not limited to, a stabilizer such as an antioxidant and a light stabilizer, a flame-retardant, an antistatic agent, a filler, a colorant, and so on. The covering 62 is disposed on the core 61, but is removed at the tip portion of the electrical conduit 6. In other words, the core 61 is exposed at the tip portion of the electrical conduit 6.

The connector housing 3 may be made of an insulating material such as an insulating synthetic polymer. The connector housing 3 is integrally molded with both the electrical conduit 6 and the terminal fitting 2. In addition, in the area of the connector housing 3 the end portion 6*a* of the electrical conduit 6, the electrical conduit-connecting portion 22 of the terminal fitting 2, and the base end portion 23 and the center portion 24 of the electric contact portion 21 are embedded, and are simultaneously in close contact therewith. The connector housing 3 is integrally formed with a housing body 31, an electrical conduit-holding portion 32, a brush portion 33, and a terminal-holding portion 34.

The housing body 31 is box-shaped, and has the end portion 6*a* of the electrical conduit 6, the electrical conduit-connecting portion 22 of the terminal fitting 2, and the base end portion 23 of the electric connect portion 21 being embedded therein and being in close contact therewith. The electrical conduit-holding portion 32 extends from or projects from the housing body 31. The electrical conduit-holding portion 32 leads the electrical conduit 6 away from the housing body 31. The electrical conduit-holding portion 32 has the end portion 6*a* of the electrical conduit 6 embedded therein, and is thus in close contact therewith.

The brush portion 33 is brush-shaped, and is formed in the end portion of the housing body 31 away from the electrical conduit-holding portion 32. The terminal-holding portion 34 extends from the housing body 31 in an orthogonal direction relative to the electrical conduit-holding portion 32. Two of the terminal-holding portion 34 may be formed in response to two of the terminal fitting 2. Each terminal-holding portion 34 has the center portion 24 of the electric contact portion 21 of the terminal fitting 2 embedded therein, and is in simultaneously close contact with the center portion 24.

Figure 4:
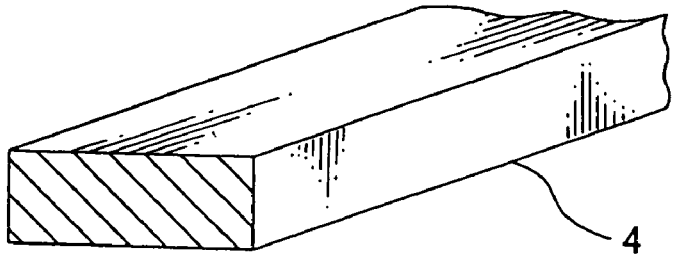
FIG. 4 is a cross-section perspective view for the sealing member as shown in FIG. 2.
Figure 6:
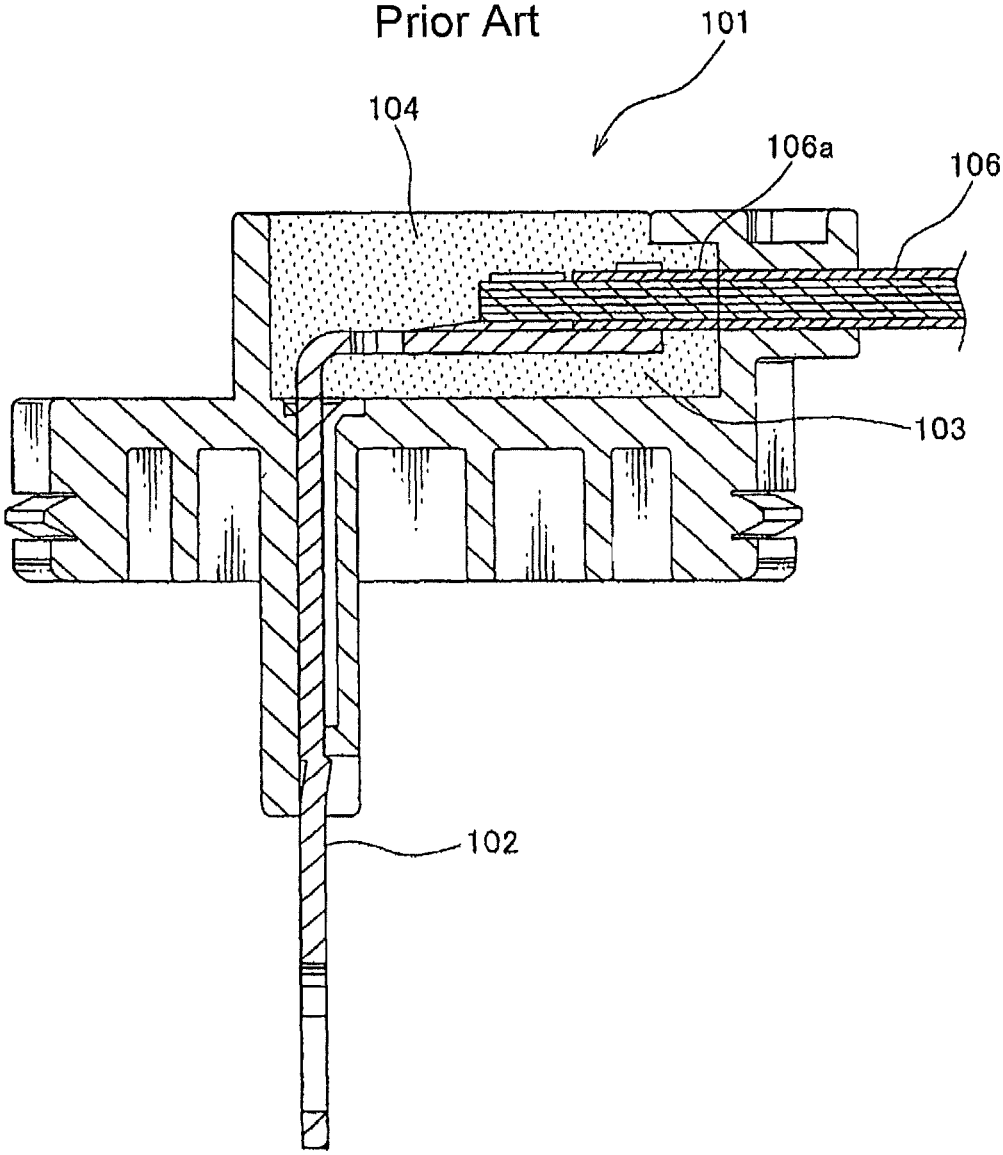
FIG. 6 Prior Art
FIG. 6 is a cross-sectional view for a conventional waterproof connector.

A sealing member 4 may be made of adhesive and elastic synthetic polymer, and may be tape-shaped, as shown in FIG. 4. In a case where the sealing member 4 is totally made of adhesive and elastic synthetic polymer, additional adhesive such as an adhesive tape is not required. The afore-mentioned synthetic polymer may be a potting material 104 which is generally employed in the conventional waterproof connector 101 as depicted in FIG. 6.

The adhesive and elastic synthetic polymer includes, but is not limited to, a silicone rubber, butyl rubber and so on. This is because silicone rubber and butyl rubber have good adhesion properties to the outer surface of the terminal fitting 2 generally made of metal such as copper alloy, tin, silver, gold and so forth, and also have good adhesion properties to the outer surface 62*a* of the covering 62 generally made of synthetic polymer such as polyethylene, polypropylene, polyvinyl chloride and so forth. The silicone rubber and butyl rubber have self-fusing properties, the tape-shaped sealing member 4 overlapping each other thus would not create any gap therebetween. Also, since the silicon rubber and butyl rubber are inherently insulating material, these are suited for use with the present invention. In addition, the silicone rubber and butyl rubber also have good heat resistance. Accordingly, even if a waterproof connector having the silicone rubber and/or butyl rubber disposed therein is located inside an engine room for automobiles, the silicone rubber and/or butyl rubber never or hardly fracture or break despite an elevated temperature therein. For reference, when located inside the engine room, one is generally exposed or subjected to a severe or extreme degree of temperature. Any additive may be added to the silicone rubber and butyl rubber, insomuch as it does not apparently traverse the objective of the present invention.

Figure 5:
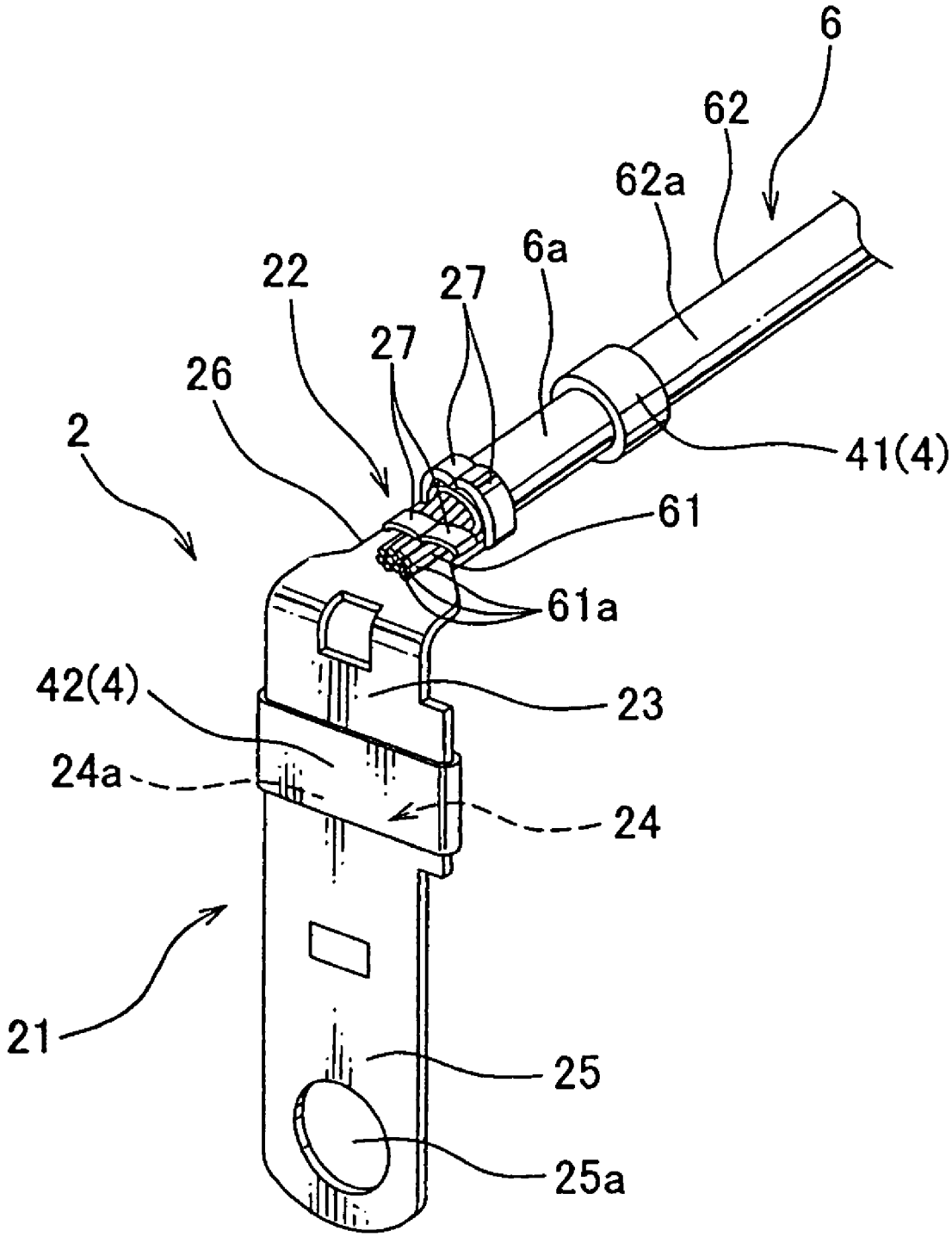
FIG. 5 is a perspective view of the state in which the sealing member is wrapped around the terminal fitting, as shown in FIG. 3

The sealing member 4 includes a first sealing member 41, and a second sealing member 42, as depicted in FIG. 5. The first sealing member 41 is wrapped around the circumference of the covering 62 at the area of end portion 6*a* of the electrical conduit 6 which is embedded in the connector housing 3. The first sealing member 41 can be in close contact with the end portion 6*a* of the electrical conduit 6, and simultaneously can retain wrapped therearound due to its adhesive properties. In other words, the first sealing member 41 can be in close contact with the end portion of the electrical conduit, in particular the outer surface 62*a* of the covering 62, and can also retain wrapped therearound.

Moreover, in a case where the connector housing 3 is subjected to molding process, the first sealing member 41 comes in close contact with the outer surface 62*a* of the covering 62 via thermal fusion bonding. As such, the first sealing member 41 completely comes in close contact with the end portion 6*a* of the electrical conduit 6. Furthermore, in a case where the connector housing 3 is subjected to molding process, the first sealing member 41 comes in close contact with the connector housing 3, which means that the first sealing member 41 is embedded into the connector housing 3. As stated above, the first sealing member 41 is in close contact with both the outer surface 6*a* of the covering 62 at the area of the end portion 6*a* of the electrical conduit 6, and the connector housing 3, liquid tightness can be securely kept therebetween.

During molding process, the temperature of molten synthetic polymer is generally 250° C., at which the synthetic polymer such as silicone rubber and butyl rubber can keep its inherent adhesion properties and elasticity. This is because 250° C. is lower than the upper limit of heatproof temperature of the afore-mentioned synthetic polymer.

The second sealing member 42 is spaced apart from the first sealing member 41, as shown in FIG. 5. The second sealing member 42 is substantially disposed such that the electrical conduit-connecting portion 22 is arranged or positioned between the first sealing member 41 and the second sealing member 42. The second sealing member 42 is wrapped around the circumference of the center portion 42 of the electric contact portion 21 which is a part of the terminal fitting 2 and is embedded in the connector housing 3. Moreover, the second sealing member 42 can be in close contact with the terminal fitting 2, more specifically, the outer surface 24*a* of the center portion 24, and can also retain wrapped therearound due to its adhesion properties.

Further, in a case where the connector housing 3 is formed via molding process, the second sealing member 42 completely comes in contact with the outer surface 24*a* of the center portion 24 located in the electric contact portion 21 of the terminal fitting 2 via thermal fusion bonding. As such, the second sealing member 42 almost completely comes in contact with the terminal fitting 2. Furthermore, once the connector housing 3 is subjected to molding process, the second sealing member 42 comes in close contact with the connector housing 3, which means that the second sealing member 42 is embedded into the connector housing 3. As stated above, the second sealing member 42 is in close contact with both the outer surface 24*a* of the center portion 24 located in the electric contact portion 21 of the terminal fitting 2, and the connector housing 3, liquid tightness can be securely kept therebetween.

During the preparation of the afore-mentioned waterproof connector 1, the terminals 6*a* of the electrical conduits 6 is made to overlap each other on the base plate 26 of the electrical conduit-connecting portion 22 located in the terminal fitting 2. Thereafter, by means of the caulking piece 27 the end portion 6*a* of the electrical conduit 6 is clipped or fixed to the base plate 26. In other words, the end portion 6*a* of the electrical conduit 6 is caulked around the base plate 26 by use of the caulking piece 27. As such, the terminal fitting 2 can be coupled to the end portion 6*a* of the electrical conduit 6 (refer to FIG. 3). Thereafter, the first sealing member 41 can be wrapped around the circumference of the covering 62 at the end portion 6*a* of the electrical conduit 6 such that it can be in close contact with the outer surface 62*a* of the covering 62. Furthermore, the second sealing member 42 can be wrapped around the circumference of the center portion 24 of the electric contact portion 21 located in terminal fitting 2 such that it can be in close contact with the outer surface 24*a* of the center portion 24 (refer to FIG. 5).

Thereafter, the connector housing 3 can be integrally molded with both the terminal fitting 2 and the end portion 6*a* of the electrical conduit. In this molding process, the end portion 6*a* of the electrical conduit 6, the electrical conduit-connecting portion 22 of the terminal fitting 2, and the base end portion 23 and the center portion 24 of the electric contact portion 21 can be located in a predetermined location inside a die for shaping the connector housing 3. In this situation, the first sealing member 41 wrapped around the electrical conduit 6 and the second sealing member 42 wrapped around the terminal fitting 2 may be also disposed inside the die. Molten synthetic polymer is injected into the die, and then is cooled for the purpose of curing. Then, the resultant article can be removed from the die.

Due to such a molding process, both the exposed core 61 (i.e., the tip portion of the electrical conduit 6) leaded away from the end portion 6*a* of the electrical conduit 6 and the outer surface 62*a* of the covering 62 can be in close contact with the housing connector 3. For reference, both the exposed core 61 and the outer surface 62*a* of the covering 62 are not substantially wrapped therearound by the first sealing member 41. Furthermore, the electrical conduit-connecting portion 22, and the base end portion 23 and the center portion 24 of the electric contact portion 21 can be in close contact with the housing connector 3. For reference, the electrical conduit-connecting portion 22, and the base end portion 23 and the center portion 24 of the electric contact portion 21 are not wrapped therearound by the second sealing member 42.

Further, the first sealing member 41 is securely in close contact with the outer surface 62*a* of the covering 62 of the electrical conduit 6 via thermal fusion bonding. The second sealing member 42 is securely in close contact with the outer surface 24*a* of the center portion 24 of the terminal fitting 2 via thermal fusion bonding. As such, the waterproof connector in accordance with one embodiment of the present invention can be obtained.

In accordance with the afore-mentioned embodiment of the present invention, the sealing member 4 is made of synthetic polymer material having adhesion properties and elasticity, and is embedded in the connector housing 3 while being in close contact with both the covering 62 disposed in the end portion 6*a* of the electrical conduit 6, and the terminal fitting 2. Therefore, even if the end portion 6*a* of the electrical conduit 6 (i.e., the covering 62), the terminal fitting 2, and the connector housing 3 are differently expanded due to ambient temperature change, the sealing member 4 will not peel off or be delaminated from the electrical conduit 6, the terminal fitting 2, and the connector housing 3. If the waterproof connector 1 in accordance with one embodiment of the present invention is subjected to oscillation or vibration, the sealing member 4 can itself alleviate or eliminate such an oscillation or vibration. In other words, any gap will not be allowed to create between the sealing member 4 and the electrical conduit 6, between the sealing member 4 and the terminal fitting 2, and the sealing member 4 and the connector housing 3. Therefore, liquid such as water is never permitted to permeate into the waterproof connector 1, and is securely prevented from adhering to the connection between the terminal fitting 2 and the electrical conduit 6 (for example, the electrical conduit-connecting portion 22).

The first sealing member 41 and the second sealing member 42 are spaced apart from each other such that the electrical conduit-connecting portion 22 is arranged therebetween. In this configuration, the first sealing member 41 is in close contact with the end portion 6*a* of the electrical conduit 6, and the second sealing member 42 is in close contact with the terminal fitting 2. Accordingly, the electrical conduit-connecting portion 22 is not required to be wrapped therearound by the sealing member 4. As a result, the usage of the sealing member 4 is greatly reduced, thus causing decline in cost. In addition, an environmentally-friendly article can be produced.

The sealing member 4 formed of synthetic polymer and having adhesion properties and elasticity is wrapped around both the end portion 6*a* of the electrical conduit 6, and the terminal fitting 2 having the electrical conduit-connecting portion 22 connected to the end portion 6*a* of the associated electrical conduit 6 such that it comes in close contact with both the end portion 6*a* of the electrical conduit 6, and the terminal fitting 2. Thereafter, the housing connector 3 is integrally molded with both the end portion 6*a* of the electrical conduit 6 and the terminal fitting 2 such that at least the electrical conduit-connecting portion 22 and the sealing member 4 are embedded in the housing connector 3. Accordingly, contrary to the preparation of the conventional waterproof connector 101 as depicted in FIG. 6, a period of time is not needed for the curing of the potting material 104. In other words, the product is not required to remain in-line during the curing process, and the productivity of final product can be thus greatly enhanced.

While the afore-mentioned embodiment of the present invention employs the sealing member 4 having geometry of tape, the present invention is never limited thereto. More specifically, for example, the sealing member 4 having geometry of sheet may be employed in the implementation of the present invention. Also, while in accordance with the afore-mentioned embodiment of the present invention the first sealing member 41 is spaced apart from the second sealing member 42, the sealing member 4 may be wrapped around the overall end portion 6*a* of the electrical conduit 6 and the overall terminal fitting 2, if needed. However, in this configuration, the usage of the sealing member 4 will correspondingly increase.

Furthermore, in accordance with the afore-mentioned embodiment of the present invention the first sealing member 41 and the second sealing member 42 are prepared of the same synthetic polymer material, but the first sealing member 41 and the second sealing member 42 may be prepared from different synthetic polymer material to each other. For example, the first sealing member 41 may be formed of silicon rubber material, and the second sealing member 42 may be formed of butyl rubber material. Moreover, in the afore-mentioned embodiment of the present invention the terminal fitting 2 corresponds to the male-type terminal fitting, it may be also a female-type.

There are hereinafter provided several advantageous effect caused by the present invention.

In accordance with the first aspect of the invention, the sealing member comprises a synthetic polymer component having adhesion properties and elasticity, and is also embedded in the connector housing together with both the end portion of the electrical conduit, and the terminal fitting while being in close contact therewith. Accordingly, even if the end portion of the electrical conduit (i.e., the covering), the terminal fitting, and the connector housing are differently expanded due to ambient temperature change, the sealing member will not peel off or be delaminated from the electrical conduit, the terminal fitting, and the connector housing. Moreover, if the waterproof connector is subjected to oscillation or vibration, the sealing member itself can alleviate or eliminate such an oscillation or vibration. In other words, any gap will not be allowed to create between the sealing member and the electrical conduit, between the sealing member and the terminal fitting, and the sealing member and the connector housing. Therefore, liquid such as water is never permitted to permeate into the waterproof connector, and is securely prevented from adhering to the connection between the terminal fitting and the electrical conduit (for example, the electrical conduit-connecting portion).

As mentioned above, the sealing member preferably comprises a first sealing member and a second sealing member. In this configuration, the first sealing member is at least partly wrapped around the end portion of the electrical conduit so as to be in close contact with the corresponding end portion of the electrical conduit, the end portion of the electrical conduit being embedded in the connector housing; and the second sealing member is spaced apart from the first sealing member so as to position the electrical conduit-connecting portion between the first sealing member and the second sealing member, and is at least partly wrapped around the terminal fitting embedded in the connector so as to be in close contact with the corresponding terminal fitting. Accordingly, the electrical conduit-connecting portion is not required to be wrapped therearound by the sealing member. As a result, the usage of the sealing member is greatly reduced, thus causing decline in cost. In addition, an environmentally-friendly article can be produced.

In accordance with the second aspect of the invention, the method for producing a waterproof connector, comprising the steps of: at least partly wrapping a sealing member around both an end portion of an electrical conduit, and a terminal fitting having an electrical conduit-connecting portion connected to the end portion of the electrical conduit such that the sealing member is in close contact with both the corresponding end portion of the electrical conduit, and the corresponding terminal fitting; and integrally molding a connector housing together with the electrical conduit and the terminal fitting so as to imbed at least both the electrical conduit-connecting portion and the sealing member in the connector housing. In this method, the sealing member comprises a synthetic polymer component having adhesion properties and elasticity. Accordingly, contrary to the preparation of the conventional waterproof connector, a period of time is not needed for the curing of the potting material. In other words, the product is not required to remain in-line during the curing process, and the productivity of final product can be thus greatly enhanced.

Those skilled in the art will recognize that a wide variety of modifications, alterations, and combinations can be made with respect to the above described embodiments without departing from the spirit and scope of the invention, and that such modifications, alterations, and combinations are to be viewed as being within the spirit of the inventive concept.

The invention claimed is:

1. A waterproof connector, comprising:

an electrical conduit;

a terminal fitting having an electrical conduit-connecting portion connected to an end portion of the electrical conduit;

a connector housing being integrally molded with both of the electrical conduit and the terminal fitting, wherein at least the electrical-conduit connecting portion is embedded in the connector housing; and a sealing member comprising a synthetic polymer component having adhesion properties and elasticity, and being at least partly wrapped around both the end portion of the electrical conduit and the terminal fitting so as to be in close contact with both the corresponding end portion of the electrical conduit and the corresponding terminal fitting, wherein all of the corresponding end portion of the electrical conduit, the corresponding terminal fitting, and the sealing member are embedded in the connector housing, wherein the sealing member comprises, a first sealing member being at least partly wrapped around the end portion of the electrical conduit so as to be in close contact with the corresponding end portion of the electrical conduit, the end portion of the electrical conduit being embedded in the connector housing, and a second sealing member being spaced apart from the first sealing member so as to position the electrical conduit-connecting portion between the first sealing member and the second sealing member, and being at least partly wrapped around the terminal fitting embedded in the connector housing so as to be in close contact with the corresponding terminal fitting.

2. A method for producing a waterproof connector, comprising the steps of:

at least partly wrapping a sealing member around both an end portion of an electrical conduit and a terminal fitting having an electrical conduit-connecting portion connected to the end portion of the electrical conduit such that the sealing member is in close contact with both the corresponding end portion of the electrical conduit, and the corresponding terminal fitting, wherein the sealing member comprises a synthetic polymer component having adhesion properties and elasticity, and integrally molding a connector housing together with the electrical conduit and the terminal fitting so as to embed at least both the electrical conduit-connecting portion and the sealing member in the connector housing, wherein the sealing member comprises, a first sealing member being at least partly wrapped around the end portion of the electrical conduit so as to be in close contact with the corresponding end portion of the electrical conduit, the end portion of the electrical conduit being embedded in the connector housing, and a second sealing member being spaced apart from the first sealing member so as to position the electrical conduit-connecting portion between the first sealing member and the second sealing member, and being at least partly wrapped around the terminal fitting embedded in the connector housing so as to be in close contact with the corresponding terminal fitting.

* * * * *